United States Patent [19]

Gibson

[11] Patent Number: 4,618,144

[45] Date of Patent: Oct. 21, 1986

[54] PORTABLE EXERCISE DEVICE

[76] Inventor: Christopher S. Gibson, 403 St. Ronan St., New Haven, Conn. 06511

[21] Appl. No.: 669,680

[22] Filed: Nov. 9, 1984

[51] Int. Cl.[4] ..... A63B 21/00

[52] U.S. Cl. ..... 272/134; 272/136; 272/144

[58] Field of Search ..... 272/116, 117, 118, 134, 272/136, 142, 144; 108/112, 113, 115; 272/DIG. 4

[56] References Cited

U.S. PATENT DOCUMENTS

| | | | |
|---|---|---|---|
| 2,261,173 | 11/1941 | Maxwell | 272/136 |
| 2,651,353 | 9/1953 | McWain et al. | 108/115 |
| 2,739,859 | 3/1956 | Cohen | 108/115 |
| 3,524,644 | 8/1970 | Kade | 272/134 |
| 3,558,131 | 1/1971 | Dragon | 272/134 |
| 3,598,405 | 9/1971 | Burns | 272/58 |
| 3,664,666 | 5/1972 | Lloyd | 272/136 |
| 3,817,243 | 6/1974 | Perrine | 128/57 |
| 3,876,198 | 4/1975 | Seligman | 272/142 X |
| 3,902,717 | 9/1975 | Kulkens | 272/142 X |
| 3,949,983 | 4/1976 | Tommasino | 272/57 |
| 4,072,309 | 2/1978 | Wilson | 272/136 |
| 4,098,502 | 7/1978 | Faust | 272/144 |
| 4,136,868 | 11/1982 | Hogue | 272/144 |
| 4,149,715 | 4/1979 | Kusmer | 272/136 X |
| 4,300,761 | 11/1981 | Howard | 272/134 |
| 4,316,609 | 2/1982 | Silberman | 272/118 |
| 4,319,747 | 3/1982 | Rodgers | 272/123 X |
| 4,358,109 | 1/1979 | Schrems | 272/144 |
| 4,465,274 | 8/1984 | Davenport | 272/134 X |
| 4,492,375 | 1/1985 | Conweut | 272/134 |
| 4,509,746 | 4/1985 | Mask | 272/134 |

FOREIGN PATENT DOCUMENTS

| | | | |
|---|---|---|---|
| 2335022 | 1/1975 | Fed. Rep. of Germany | 272/134 |
| 2524329 | 10/1983 | France | 272/136 |
| 8005681 | 5/1982 | Netherlands | 272/134 |

*Primary Examiner*—Richard J. Apley
*Assistant Examiner*—Robert W. Bahr

[57] ABSTRACT

A self-contained hand transportable portable exercise device for performing upper and lower body exercises is enclosed having a freestanding support frame with an upper portion, a lower ground engaging base, and a storage space therebetween, a horizontal seat member securely mounted to the upper portion of the support frame being of sufficient length for sitting exercises and insufficient length for prone-supine bench exercises, a bench extension member pivotally mounted to the support frame at the rearward end of the seat member for pivotal movement between a horizontal position in alignment with the seat member to form an elongated bench of sufficient length for prone-supine bench exercises and a downwardly extending position along the rearward end of the support frame for transport and storage, a support assembly for supporting the bench member in the horizontal position and for disposition within the storage spaced when the bench extension member is in the transport position, an upper body exercise assembly for performing upper body exercises detachably mountable to the support frame and alternately detachably mountable to the support frame within the storage space for transport a lower body exercise assembly for performing lower body exercises detachably mountable to the support frame and alternately detachably mountable to the support frame within the storage space for transport with the upper body exercise assembly and the lower body exercise assembly being simultaneously mountable to the support frame within the storage space when the bench extension member is in the transport position to form a compact configuration for transport and storage.

28 Claims, 8 Drawing Figures

PORTABLE EXERCISE DEVICE

BACKGROUND AND SUMMARY OF THE INVENTION

This invention relates to a physical exercise device and more particularly to a self-contained, hand-transportable exercise device for use while traveling and in space-limited environments, such as in an office.

Athletes and other performers and artists, such as dancers, must regularly perform various specific physical exercises to maintain proper body conditioning. While traveling, the performance of such exercises may be inconvenient or impossible since many of the exercise routines require exercise machines or devices which heretofore were large and cumbersome and required attachment to a building support. Additionally, the size and immobility of the prior exercise devices restricted utilization in space-limited environments, such as apartments, offices, etc.

Accordingly, it is an object of the present invention to provide a self-contained, hand-transportable portable exercise device for performing upper and lower body exercises including those exercises commonly identified as the bench press exercise, the bicep curl-lateral pull exercise, the back-of-neck press exercise, the tricep pushdown exercise, the dorsi bar pulldown exercise, the military press exercise, the donkey press exercise, the vertical rowing exercise, the leg extension exercise, and the leg curl exercise. Included in this object is the provision of an exercise device for performing such exercises without the use of weights.

A further object of the invention is to provide a stable, freestanding portable exercise device which can be assembled into a compact, space efficient configuration.

A further object of the invention is to provide a self-contained portable exercise device that is convenient for travel and space efficient for storage and use.

It has been found that the foregoing and related objects and advantages can be obtained in a portable exercise device comprising a freestanding support frame having an elongated upper portion and a lower ground engaging base forming a storage space therebetween. A horizontal seat member is rigidly mounted to the upper portion of the support frame and is of sufficient length for sitting exercises and insufficient length for prone-supine bench exercises. A bench extension member is pivotally mounted to the support frame at the rearward end of the seat member for pivotal movement between first and second positions. The bench extension member in the first position is in horizontal alignment with the seat member to form an elongated bench of sufficient length for prone-supine bench exercises and extends downwardly along the rearward end of the support frame generally perpendicular to the seat frame in the second position for transport and storage. A support leg is connected to the bench member for securely supporting the bench extension member in the first position and which is disposed within the storage space below the seat member when the bench extension member is in the second position. An upper body exercise assembly for performing upper body exercises is detachably mountable to the support frame at the forward end of the seat member for performing upper body exercises on the elongated bench and is alternately detachably mountable to the support frame within the storage space under the seat member for transport and storage. A lower body exercise assembly for performing lower body exercises is detachably mountable to the support frame at the forward end of the seat member for performing lower body exercises and is alternately detachably mountable to the support frame within the storage space for transport and storage. The upper body exercise assembly and the lower body exercise assembly are simultaneously mountable to the support frame within the storage space when the extension member is in the second position to form a compact, hand-transportable configuration for transport and storage.

Other objects will be in part obvious and in part pointed out more in detail hereinafter.

DESCRIPTION OF THE PREFERRED EMBODIMENT

Figure 1:
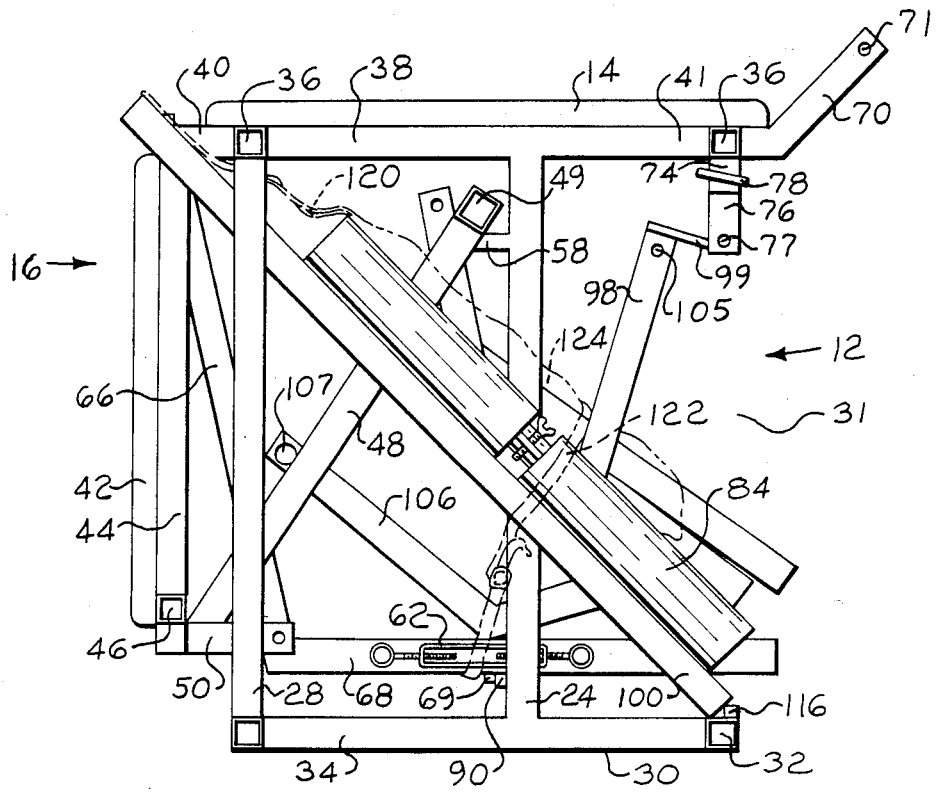
FIG. 1 is a side view of the portable exercise device of the present invention assembled in the transport/storage configuration.
Figure 2:
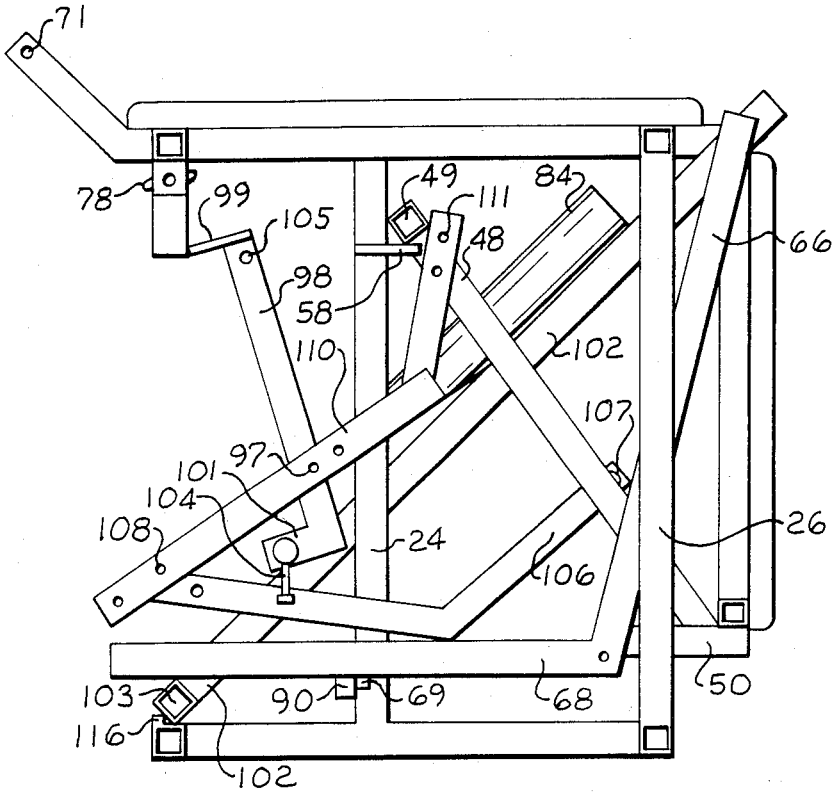
FIG. 2 is an opposite side view of the configuration of FIG. 1.
Figure 3:
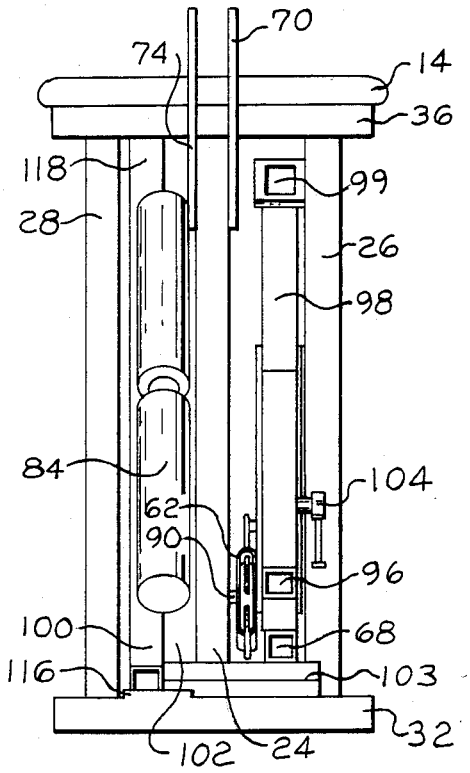
FIG. 3 is a front view of the configuration of FIG. 1.

Referring to the drawings, the exercise device of the present invention is shown in the compact storage/transport configuration in FIGS. 1–3 and in various operational configurations for upper and lower body exercises in Figures 4–7.

The portable exercise device generally comprises a free standing support frame 12, a seat member 14, a bench extension 16, an upper body exercise assembly 18, and a lower body exercise assembly 20.

Figure 8:
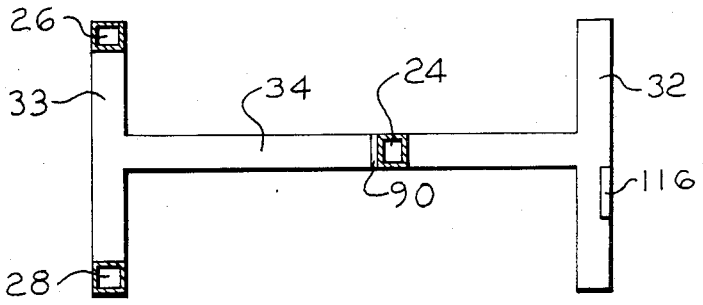
FIG. 8 is a sectional view seen on line 8—8 of FIG. 5.

The support frame 12 has an upper support section 22 rigidly interconnected by the support legs 24, 26, 28 to a ground-engaging support base 30 with the upper support section 22 and base 30 forming a storage space 31 therebetween. The base 30 is "I" shaped having transverse end segments 32, 33 rigidly connected to a longitudinal web segment 34 as shown in FIG. 8. The transverse segments 32, 33 and the web segment 34 are dimensioned to attain stable freestanding support of the exercise device.

The upper support section 22 is "I" shaped identical to base 30 and has transverse segments 36 rigidly interconnected by a longitudinal web segment 38. The seat member 14 is securely mounted to the upper support segment 22 so as to be generally horizontal when the exercise device is freestanding on the ground. The seat member 14 is rigid having a soft, resilient outer covering to provide a cushioned support surface and is of sufficient length for sitting exercises but is not of sufficient length, per se, to permit prone-supine bench exercises.

Figure 5:
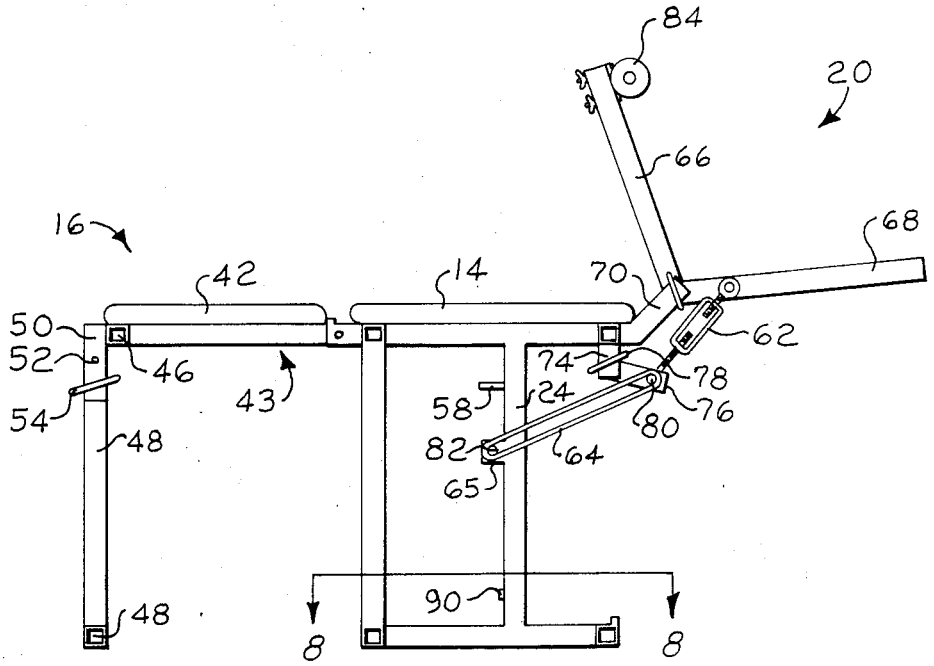
FIG. 5 is a side view similar to FIG. 4 of the exercise device in an alternate configuration for performing leg curl exercises.

The bench extension 16 is pivotally mounted about a pivot axis 45 to the rearward end 40 of the upper support section 22 of the support frame 12. The bench extension 16 comprises a rigid cushioned support member 42 similar to seat member 16 which is securely mounted on a "T"-shaped frame 43 having a central longitudinal segment 44 rigidly connected to a transverse segment 46. The longitudinal segment 44 is pivotally connected at its distal end to the rearward end 40 of upper support section 22 for pivotal movement of the bench extension 16 between a first folded position, as shown in FIG. 2, and a second operational position, as shown in FIG. 5.

In the folded position, the bench extension 16 extends downwardly along the rearward end of the support frame 12 generally perpendicular to the seat member 14 to form a compact configuration for transport and storage. In the operational position, the bench extension 16 is in a horizontal alignment with the seat member 14 to form, in combination with seat member 14, an elongated bench of sufficient length for prone-supine bench exercises.

Figure 4:
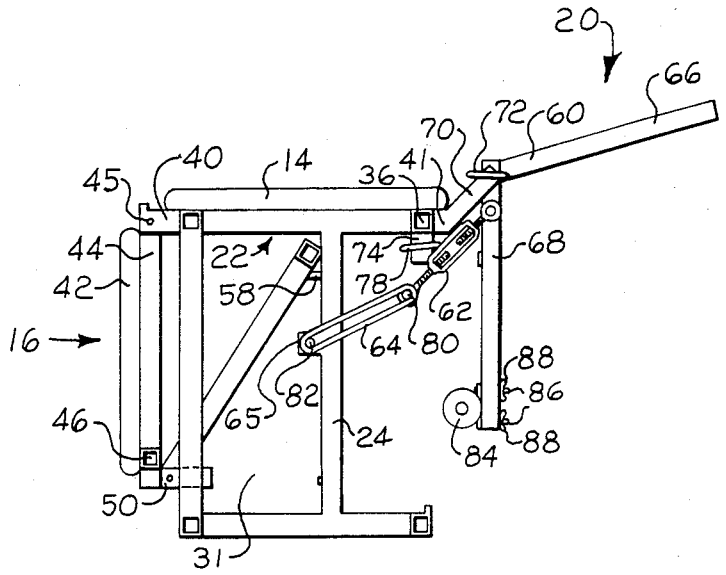
FIG. 4 is a side view of the exercise device in a configuration for performing leg extension exercises.

A support leg 48 securely supports the bench extension 16 in the operational position and is releasably pivotally connected to the frame 43 for disposition within the storage space 31 when the bench extension 16 is in the first position as shown in FIG. 4. A yoke 50 is rigidly connected to the transverse member 46 of the frame 43 of the bench extension member 16. The support leg 48 is pivotally mounted in the yoke 50 about a pivot axis 52. A removable mounting pin 54 locks the support leg 48 within the yoke 54 to prevent pivotal movement when the extension member 16 is in the second position. The support leg 48 has a transverse ground engaging base 49 which is mountable on a stud 58 projecting from support leg 24 of frame 12 when the extension member 16 is in the first position as shown in FIGS. 2 and 4.

Referring to FIG. 4, the lower body assembly 20 comprises a rigid lever bracket 60, a length adjustable link 62 and a tension biasing loop or spring 64. The lever bracket 60 has two rigidly connected arms 66, 68 forming an obtuse angle therebetween and adapted to alternately mount a leg engaging pad 84 at the distal ends thereof. The obtuse angle of the arms 66, 68 facilitates the proper positioning of the leg pad 84 for the exercises noted hereinafter and the compact storage of the bracket 60 within the storage space 31.

A yoke 70 is rigidly connected to the transverse segment 36 at the forward end 41 of the support frame 12. The yoke 70 extends from the transverse segment 36 upwardly above the seat member 14. The lever bracket 60 is detachably pivotally mounted to the yoke 70 about a pivot axis 71 by a removable mounting pin 72.

Another yoke 74 is rigidly connected to the transverse segment 36 and extends downwardly therefrom to pivotally mount a pivotal connecting link 76. The connecting link 76 is detachably pivotally mounted at one end to the yoke 74 by a removable mounting pin 78 and, at the other end the connecting link 76 slidably mounts a transverse connecting bar 80 for simultaneously mounting the adjustable link 62 and the biasing loop 64. An aperture 77 in the connecting link 76 slidably mounts the connecting bar 80.

The adjustable link 62 is pivotally mounted at one end to the arm 68 of the lever bracket 60 and detachably pivotally mounted at the other end to the connecting bar 80. The biasing loop 64 interconnects the connecting bar 80 with a similar connecting bar 82 detachably mounted to a projection 65 from the support leg 24 of frame 12 as shown in FIG. 4. The connecting bar 82 is slidably mounted within the aperture 67 of projection 65.

The biasing loop 64 biases the arm 68 in a direction under the seat member 14 (i.e., in a clockwise direction as seen in FIG. 4). Consequently, the biasing loop 64 provides a predetermined tension against angular movement of the lever bracket 60 in the opposite (counterclockwise) direction during the performance of lower body exercises. The adjustable link 62 may be utilized to remove any play in the interconnected assemblage and provide a taut interconnection of the biasing loop 64, the connecting link 76 and the lever bracket 60. A taut interconnection is desirable for a smooth, even movement of the lever bracket 60 during exercising. Also, the link 62 may be adjusted to regulate the biasing force exerted on the lever bracket 60.

The leg engaging pad 84 is alternately detachably mountable to the arms 66, 68 for performing either leg extension exercises or leg curl exercises. The leg pad 84 has a pair of bolts 86 for detachable securement via wing nuts 88 to the distal ends of the arms 66, 68. Each arm has a plurality of bolt receiving apertures (not shown) at the distal end portion to permit selective positioning of the leg pad 84 relative to the leg size of the user. The leg pad 84 has an elongated cylindrical shape with a cushioned outer surface.

Referring to FIG. 4, the leg pad 84 is securely mounted to the inner distal end portion of the arm 68 for performing the leg extension exercise. The extension member 16 may remain folded downwardly during this exercise so that the overall length of the exercise device is minimized. In this configuration, leg extension exercises may be performed within an extremely limited space.

Furthermore, the support leg 24 is disposed inwardly from the forward end of the frame 12 so that the legs of the user may be retracted under the seat member 14 to permit a full extension leg extension exercise. In this regard, the specific configuration of the ground engaging base 30 in combination with the positioning of the support legs 24, 26, 28 provides a stable freestanding exercise device which permits the user to attain full-extension leg extension exercises.

Referring to FIG. 5, the exercise device is configured for leg curl exercises. The bench extension 16 is pivoted to the second position in horizontal alignment with the seat member 14 to form an elongated bench to support the user in a prone position. The support leg 48 is pivoted into a ground engaging position and locked therein by insertion of the locking pin 54. The leg engaging pad 84 is attached to the outwardly facing surface of the distal end of the arm 66.

In the compact transport configuration of FIG. 1, the lower body exercise assembly 20 is mountable to the support frame 12 within the storage space 31. The lever bracket 60 is dimensioned and configured to fit within the storage space 31 such that the arm 68 is mounted upon the lateral peg 90 of support leg 24 with the adjustable link 62 also mounted on the peg 90 and disposed between the arm 68 and the support leg 24. A tab 69 on the arm 68 abuts the lateral peg 90 to retain the lever bracket 60 in place. As can be seen in FIG. 2, the distal end portion of the arm 66 rests upon the forwardly disposed end of the bench member 16 and the distal end portion of the arm 68 rests upon a portion of the upper body exercise assembly 18, i.e., section 103 of stanchion 94 when the exercise device is in the compact transport/storage configuration. As will be explained subsequently, the leg pad 84, the pins 54, 72, 78 and the biasing loop 64 are also stored together within the storage space 31.

Figure 6:
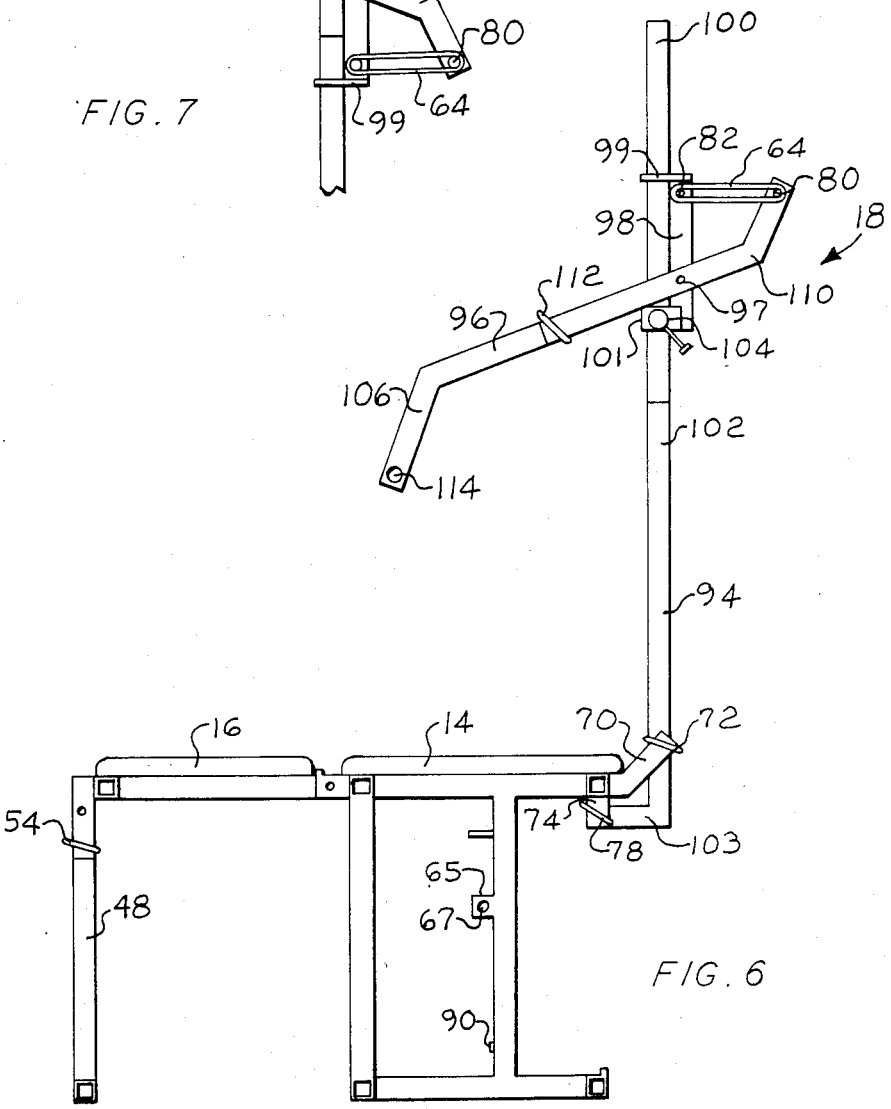
FIG. 6 is a side view of the exercise device in a configuration for performing upper body exercises.

Referring to FIG. 6, the upper body exercise assembly 18 of the present invention generally comprises a support stanchion 94, an exercise lever arm 96, a support bar 98, and a biasing loop 64.

The stanchion 94 is comprised of a straight hollow upper section 100 mounted in telescopic relationship to an "L" shaped hollow lower section 102. The lower stanchion section 102 is mounted to both yokes 70, 74 by pins 72, 78 respectively to securely mount the stanchion to the support frame 12. The upper stanchion section 100 telescopically mounts within the upper end of the stanchion section 102 to provide an elongated vertically extending support stanchion sufficient to carry the exercise arm 96 at selectable vertical heights according to the user and the desired exercise.

The support bar 98 pivotally mounts the exercise arm 96 about a pivot axis 97 and has aligned vertically extending channels 99, 101 to slidably receive the support stanchion 94. A manually adjustable friction lock 104 connected to channel 101 securely locks the support bar 98 to the stanchion 94 and permits the support bar to be positioned at any vertical height along the stanchion 94.

The exercise arm 96 is comprised of inner and outer end segments 106, 110 pivotally connected about a pivot axis 108. A removable mounting pin 112 securely interlocks segments 106, 110 in the aligned configuration of FIGS. 6 and 7 for use in performing upper body exercises.

The end segment 110 has an aperture 111 for slidably mounting connecting bar 80. Similarly, the support bar 98 has an aperture 105 for slidably mounting connecting bar 82 adjacent connecting bar 80. The biasing loop 64 is mounted about the connecting bars 80, 82 to bias the inner end 106 of the lever arm 96 downwardly (i.e., counterclockwise as seen in FIG. 4).

A handle 114 is slidably mounted within an aperture 107 at the distal end of inner segment 106. The handle 114 is comprised of two elongated segments threadably interconnected to allow disassembly for storage within the hollow sections 100, 102 of the support stanchion 94 when the exercise device is in the transport configuration of FIGS. 1–3.

In the configuration of FIG. 6, upper body exercises requiring tension resistance to the upward movement of the inner end 106 of the exercise arm 96 can be performed, e.g., the military press exercise. The vertical height of the exercise arm 96 is infinitely selectable to accommodate particular sitting and supine exercises as well as the height of the user.

Figure 7:
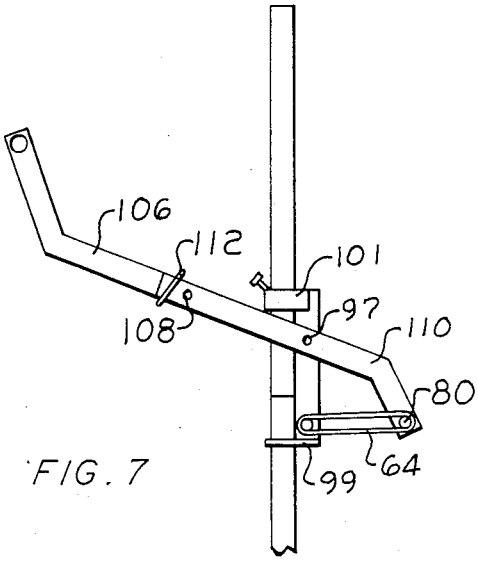
FIG. 7 is a partly broken away side view similar to FIG. 6 of the exercise device in an alternate configuration for performing upper body exercises.

To perform upper body exercises wherein tension resistance to the downward movement of the inner end 96 is required, e.g., the dorsi bar pulldown exercise, the mounting of the support bar 98 on the stanchion 94 is simply vertically inverted from the position of FIG. 6 so that the channel 99 is vertically below the channel 101 as shown in FIG. 7. That is, the friction lock 104 is released, the support bar 98 is slidably unmounted from the stanchion 94, inverted, and remounted as shown in FIG. 7. Accordingly, the biasing loop 64 now provides a predetermined tension against downward movement of the inner end 106 of the exercise arm 96.

Thus, the upper body assembly 18 in the configurations as shown in FIGS. 6 and 7 permit the performance of numerous exercises including the bench press exercise, the bicep curl-lateral pull exercise, the back-of-the neck press exercise, the tricep pushdown exercise, the dorsi bar pulldown exercise, the military press exercise, the donkey press exercise, and the vertical pulling exercise. These common exercises are pictorially illustrated in the catalog entitled "SOLOFLEX '84", copyrighted 1983 by Soloflex Company of Hillsboro, Oreg., which catalog is incorporated herein by reference to illustrate these common exercises.

In the transport configuration of FIGS. 1–3, the upper body assembly 18 is stored in the storage space 31 mounted to the support frame 12. Specifically, the handle 114 is disassembled into its two component parts with one component part being stored within the hollow body of section component part being stored within the hollow body of section 100 of stanchion 94. The base end 103 of the "L"-shaped lower section 102 of stanchion 94 is supported atop the transverse segment 32 of frame 12 and retained in place by the upwardly projecting retaining tab 116 on transverse segment 32. The opposite end 118 of the lower section 102 is supported against the upper edge of the bench extension 16 and the middle portion abuts support leg 24 of frame 12.

Referring to FIGS. 1 and 3, the upper segment 100 of stanchion 94 is positioned adjoining the lower section 102 with its lower end also in engagement with the retaining tab 116 and the upper end being supported by the upper edge of the bench extension 16. The lower section 102 is sandwiched between the upper section 100 and the support leg 24 as shown in FIG. 3.

The leg pad 84 is mounted atop the stanchion sections 100, 102 with one of the bolts 86 being received within the aperture 67 of projection 65 of support leg 24 to securely mount the leg pad within the storage space 31.

The lever bracket 60 is mounted within the storage space 31 as previously described and best shown in FIG. 2. The mounting pin 112 is removed from the exercise arm 96 to permit the inner end 106 to be folded back upon the support bar 98 in a compact configuration which is mountable within storage space 31 atop the arm 68 of lever bracket 60 with the outer end segment 110 being wedged against the bench support leg 48.

The four mounting pins 54, 72, 78, 112, the biasing loops 64, the connecting bars 80, 82 and the connecting link 76 are stored within a small pouch 124 (shown in phantom in FIG. 1 only for purposes of explanation) which lies against the leg pad 84 and has a cord loop 120 that encircles the upper end 118 of stanchion segment 102. A small belt 122 (also shown in phantom) encircles the upper and lower body exercise assembly components to ensure stability during transport however the components are securely supported within the storage space 31 without the belt 122 by virtue of the interconnection of the components to the support frame 12.

In the illustrated embodiment, the transport/storage configuration of FIGS. 1–3 is generally a rectangular hexahedron shape approximately 25 inches in length, 14½ inches in width and 25 inches high to the end of yoke 70. Preferably, the exercise device is made of strong, lightweight, square aluminum tubing so that it is lightweight and hand-transportable.

As can be seen, a self-contained hand-transportable exercise device is provided for performing numerous upper and lower body exercises without the utilization of weights. The exercise device provides a stable, free-standing portable device easily assembled into the various exercise configurations without tools and which can be reassembled into a compact, space efficient configuration which is convenient for travel and storage.

As will be apparent to persons skilled in the art, various modifications and adaptations of the structure above described will become readily apparent without departure from the spirit and scope of the invention, the scope of which is defined in the appended claims.

I claim:

1. A self-contained portable exercise device for performing upper and lower body exercises readily convertible into an interconnected compact hand transportable portable configuration comprising, a freestanding support frame having a ground-engaging base and a substantially horizontally extending upper portion for mounting a horizontal seat member, said upper portion being spaced from said base so as to form a storage space therebetween, said support frame having opposed forward and rearward ends, a horizontal seat member securely mounted to said upper portion of said support frame and having forward and rearward ends, said seat member being of sufficient length for sitting exercises and insufficient length for prone-supine bench exercises, a bench extension member movably mounted to said support frame at said rearward end of said seat member for movement between a first position in horizontal alignment with said seat member to form an elongated bench with said seat member of sufficient length for prone-supine bench exercises and a second position extending adjacent said storage space for transport and storage, means for securely supporting said bench member in said first position for bench exercises and for disposition within said storage space when said bench extension member is in said second position, an upper body exercise assembly means for performing upper body exercises without weights, support extension means for selective vertically adjustable mounting of said upper body exercise assembly means substantially above said seat member, said support extension means being detachably mounted to said support frame so as to extend vertically upwardly therefrom and alternately detachably mountable to said support frame substantially within said storage space in the compact portable configuration, said upper body exercise assembly means being detachably adjustably mountable to said support extension means above said seat member for performing upper body exercises on said elongated bench and alternately detachably mountable to said support frame substantially within said storage space in the compact portable configuration, a lower body exercise assembly means for performing lower body exercises without weights being detachably mountable to said support frame at said forward end of said seat member for performing lower body exercises and alternately detachably mountable to said support frame substantially within said storage space in the compact portable configuration, and said upper body exercise assembly means, said support extension means and said lower body exercise assembly means being simultaneously mountable to said support frame substantially within said storage space when said bench extension member is in said second position to form the compact portable configuration for transport and storage.

2. The device of claim 1 wherein said upper body exercise assembly means includes means for performing a bench press exercise, a bicep curl-lateral pull exercise, a back-of-neck press exercise, a tricep pushdown exercise, a dorsi bar pulldown exercise, a military press exercise, a donkey press exercise, and a vertical rowing exercise.

3. The device of claim 1 wherein said lower body exercise assembly means includes means for performing a leg extension exercise and a leg curl exercise.

4. The device of claim 1 wherein aid support frame comprises a plurality of vertically extending legs with at least one leg interconnecting said upper portion of said support frame to said ground engaging base, said legs being disposed remote from said forward end of said seat member sufficient to permit retraction of a user's legs inwardly past said forward end of said seat member under said seat member in performing a leg extension exercise with said lower body exercise assembly means.

5. The device of claim 4 wherein said base includes a "T" shaped portion comprising a ground engaging transverse segment connected to a perpendicular ground engaging longitudinal segment, said transverse segment being disposed at said forward end of said support frame with said at least one vertical leg interconnecting said longitudinal segment and said upper portion of said support frame.

6. The device of claim 1 wherein said lower body exercise assembly means comprises, a lever bracket having first and second arms adapted to mount a leg engaging pad, said bracket being detachably pivotally mountable to said support frame at said forward end of said seat member so that a pad mounted on said first arm is pivotable below said seat member and a pad mounted on said second arm is pivotable above said seat member, said bracket being dimensioned and configured for detachable mounting in said storage space to said support frame for transport and storage, and means for biasing said bracket to pivot said first arm in a direction under said seat member, said biasing means being detachably interconnected to said bracket and said support frame.

7. The device of claim 6 wherein said lower body exercise assembly means comprises, said first and second arms each having distal and proximal ends with said arms being rigidly connected together at said proximal ends to form an obtuse angle and said distal ends having means for detachably mounting a leg engaging pad, and a leg engaging pad detachably mountable to said first arm for performing leg extension exercises and alternately detachably mountable to said second arm for performing leg curl exercises.

8. The device of claim 6 wherein, a first link is pivotally mounted at one end to said forward end of said support frame, a second link pivotally interconnects said first arm of said bracket and the other end of said first link, and a resilient biasing loop interconnects said other end of said first link to said support frame to bias said first arm in a direction under said seat member, said second link being length adjustable to vary the biasing force of said loop acting on said first arm.

9. The device of claim 1 wherein said support extension means comprises a vertical support stanchion detachably mountable to sid forward end of said support frame so as to extend verticaly above said seat member, and said upper body exercise assembly means co mprises a pivotal exercise arm detachably mountable to said support stanchion so as to extend over said seat member, means for detachably mounting said exercise arm to said support stanchion at any preselected vertical position on said support stanchion, and means for biasing sid pivotal exercise arm in a clockwise angular direction and alternately in a counterclockwise angular direction.

10. The device of claim 9 wherein said means for detachably mounting said exercise arm to said support stanchion comprises a support bar slidably mounted to said stanchion and locking means for frictionally locking said bar to stanchion, said exercise arm being pivotally connected to said support bar.

11. The device of claim 10 which comprises, said support bar having first and second opposing ends and a channel means extending between said first and second ends to slidably receive said support stanchion, said exercise arm having first and second end portions, said first end portion adapted to mount a handle and extend over said seat member, said biasing means comprising a resilient biasing loop interconnecting said second end portion of said exercise arm to said support bar to angularly bias said exercise arm, said loop biasing said exercise arm clockwise when said support bar is mounted on said stanchion and said first end of said support bar is vertically above said second end and, alternately, said loop biasing said exercise arm counterclockwise when said support bar is mounted on said stanchion and said first end of said support bar is vertically below said second end.

12. The device of claim 10 which comprises, said support stanchion having first and second hollow stanchion segments telescopically interconnecting to form sid stanchion and being detachably mountable to said support frame within said storage space, said exercise arm having a transverse handle detachably mountable at one end, said handle being stowable within said hollow stanchion segments, and said exercise arm being foldable against said support bar for detachable mounting to said support frame within said storage space.

13. The device of claim 1 wherein said means for securely supporting said bench member comprises a support leg connected to said bench extension member for securely supporting said bench extension member in said first position and being disposed within said storage space below said seat member when said bench extension member is in said second position.

14. The device of claim 1 wherein said support frame is configured to form a generally rectangular hexahedron shape so that said exercise device is generally rectangular hexahedron shaped when said upper body exercise assembly means and said lower body exercise assembly means are simultaneously mounted within said storage space and said bench extension member is in said second position.

15. The device of claim 1 wherein said upper portion and said seat member define substantially the uppermost limit of the exercise device in the compact portable configuration and said base defines substantially the lowermost limit of the exercise device in the compact portable configuration.

16. A self-contained exercise device in a compact, hand-transportable configuration and readily assemblable for performing upper and lower body exercises comprising a freestanding support frame having a substantially horizontally extending upper portion, an opposed spaced apart lower ground-engaging base, and opposed forward and rearward ends, said base and said upper portion forming a storage space therebetween, a horizontal seat member securely mounted to said upper portion of said support frame and having forward and rearward ends, said seat member being of sufficient length for sitting exercises and insufficient length for prone-supine bench exercises, said base and said upper portion with said seat member defining substantially the perimeter of said storage space with said seat member and said upper portion defining substantially the uppermost portion of said exercise device and said base defining substantially the lowermost portion of said exercise device, a bench extension member mounted to said support frame so as to extend along the perimeter of said storage space, said bench extension member being mountable to said support frame at said rearward end of said seat member in horizontal alignment with said seat member to form an elongated bench with said seat member of sufficient length for prone-supine bench exercises, an upper body exercise assembly means for performing upper body exercises without weights, said upper body exercise assembly means being positioned substantially within said storage space and detachably mounted to said support frame, support extension means for selectively vertically adjustably mounting said upper body exercise assembly means substantially above said seat member, said support extension means being positioned substantially within said storage space and detachably mounted to said support frame, said support extension means being alternately detachably mountable to said support frame so as to extend vertically upwardly therefrom and said upper body exercise assembly means being alternately detachably adjustably mountable to said support extension means so as to be disposed above said seat member for performing upper body exercises on said elongated bench, and a lower body exercise assembly means for performing lower body exercises without weights, said lower body exercise assembly means being positioned substantially within said storage space and detachably mounted to said support frame, said lower body exercise assembly means being alternately detachably mountable to said support frame for performing lower body exercises.

17. The device of claim 16 wherein said upper body exercise assembly means includes means for performing a bench press exercise, a bicep curl-lateral pull exercise, a back-of-neck press exercise, a tricep pushdown exercise, a dorsi bar pulldown exercise, a military press exercise, a donkey press exercise, and a vertical rowing exercise.

18. The device of claim 16 wherein said lower body exercise assembly means includes means for performing a leg extension exercise and a leg curl exercise.

19. The device of claim 16 wherein said support frame comprises a plurality of vertically extending legs with at least one leg interconnecting said upper portion of said support frame to said ground engaging base, said legs being disposed remote from said forward end of said seat member sufficient to permit retraction of a user's legs inwardly past said forward end of said seat member under said seat member in performing a leg extension exercise with said lower body exercise assembly means.

20. The device of claim 19 wherein said base includes a "T" shaped portion comprising a ground engaging transverse segment connected to a perpendicular ground engaging longitudinal segment, said transverse segment being disposed at said forward end of said support frame with said at least one vertical leg interconnecting said longitudinal segment and said upper portion of said support frame.

21. The device of claim 16 wherein said lower body exercise assembly means comprises a lever bracket having first and second arms adapted to mount a leg engaging pad, said bracket being detachably pivotally mountable to said support frame at said forward end of said seat member so that a pad mounted on said first arm is pivotable below said seat member and a pad mounted on said second arm is pivotable above said seat member, and means for biasing said bracket to pivot said first arm in a direction under said seat member, said biasing means being detachably interconnectable to said bracket and said support frame.

22. The device of claim 21 wherein said lower body exercise assembly means comprises said first and second arms each having distal and proximal ends with said arms being rigidly connected together at said proximal ends to form an obtuse angle and said distal ends having means for detachably mounting a leg engaging pad, and a leg engaging pad detachably mountable to said first arm for performing leg extension exercises and alternately detachably mountable to said second arm for performing leg curl exercises.

23. The device of claim 21 wherein a first link is pivotally mounted at one end to said forward end of said support frame, a second link pivotally interconnects said first arm of said bracket and the other end of said first link, and a resilient biasing loop interconnects said other end of said first link to said support frame to bias said first arm in a direction under said seat member, said second link being length adjustable to vary the biasing force of said loop acting on said first arm.

24. The device of claim 16 wherein said upper body exercise assembly means comprises a vertical support stanchion detachably mountable to said forward end of said support frame so as to extend vertically above said seat member, a pivotal exercise arm detachably mountable to said support stanchion so as to extend over said seat member, means for detachably mounting said exercise arm to said support stanchion at any preselected vertical position on said support stanchion, and means for biasing said pivotal exercise arm in a clockwise angular direction and alternately in a counterclockwise angular direction.

25. The device of claim 24 wherein said means for detachably mounting said exercise arm to said support stanchion comprises a support bar slidably mounted to said stanchion and locking means for frictionally locking said bar to the stanchion, said exercise arm being pivotally connected to said support bar.

26. The device of claim 25 which comprises said support bar having first and second opposing ends and a channel means extending between said first and second ends to slidably receive said support stanchion.

said exercise arm having first and second end portions, said first end portion adapted to mount a handle and extend over said seag member, said biasing means comprising a resilient loop interconnecting said second end portion of said exercise arm to said support bar to angularly bias said exercise arm, said loop biasing said exercise arm clockwise when said support bar is mounted on said stanchion and said first end of said support bar is vertically above said second end and, alternately, said loop biasing said exercise arm counterclockwise when said support bar is mounted on said stanchion and said first end of said support bar is vertically below said second end.

27. The device of claim 25 which comprises said support stanchion having first and second hollow stanchion segments telescopically interconnecting to form said stanchion and being detachably mountable to said support frame within said storage space, said exercise arm having a transverse handle detachably mountable at one end, said handle being stowable within said hollow stanchion segments, and said exercise arm being foldable against said support bar for detachable mounting to said support frame within said storage space.

28. The device of claim 16 wherein said means for securely supporting said bench member comprises a support leg connected to said bench extension member for securely supporting said bench extension member in said first position and being disposed within said storage space below said seat member when said bench extension member is in said second position.

* * * * *